US005158575A

United States Patent [19]

Czech

[11] Patent Number: 5,158,575

[45] Date of Patent: Oct. 27, 1992

[54] SILICONE TEXTILE FINISHES

[75] Inventor: Anna M. Czech, Peekskill, N.Y.

[73] Assignee: Union Carbide Chemicals & Plastics Technology Corporation, Danbury, Conn.

[21] Appl. No.: 851,128

[22] Filed: Mar. 16, 1992

Related U.S. Application Data

[63] Continuation of Ser. No. 683,342, Apr. 10, 1991, abandoned, which is a continuation-in-part of Ser. No. 567,163, Aug. 10, 1990, abandoned.

[51] Int. Cl.[5] ..... D06M 11/00; D06M 13/00; D06M 23/00

[52] U.S. Cl. ..... 8/116.1; 8/115.7; 427/387; 428/264; 428/274; 428/452; 524/588; 524/837

[58] Field of Search ..... 8/115.7, 116.1; 427/387; 428/264, 274, 452; 524/588, 837

[56] References Cited

U.S. PATENT DOCUMENTS 4,184,004 1/1980 Pines et al. ..... 427/387 X
4,269,603 5/1981 Worth ..... 8/116.4
4,283,519 8/1981 Pines et al. ..... 528/26
4,359,545 11/1982 Ona et al. ..... 524/262
4,409,267 10/1983 Ichinohe et al. ..... 427/387
4,459,383 7/1984 Lee ..... 524/871
4,472,167 9/1984 Welch ..... 8/116.4
4,645,691 2/1987 Ona et al. ..... 427/180
4,758,646 7/1988 Raleigh et al. ..... 528/15

FOREIGN PATENT DOCUMENTS 0360248 9/1989 Fed. Rep. of Germany .

*Primary Examiner*—Michael Lusignan
*Attorney, Agent, or Firm*—B. L. Deppenbrock

[57] ABSTRACT

A durable hydrophilic silicone textile finish is produced on cellulose-containing textiles to impart durable hydrophilic softness and durable press properties to the textile. The silicone finish is produced from an aqueous solution of glyoxal, a reactive organomodified silicone copolymer, a glycol and an acidic catalyst. The treating composition is applied to the textile and cured by heating at an elevated temperature to bond the silicone to the cellulose.

17 Claims, No Drawings

SILICONE TEXTILE FINISHES

This application is a continuation of prior U.S. application Ser. No. 683,342 filed Apr. 10, 1991, now abandoned, which is a continuation-in-part of application Ser. No. 567,163 filed Aug. 10, 1990, now abandoned.

FIELD OF THE INVENTION

The present invention is directed to silicone copolymers which can produce durable hydrophilic finishes on cotton textiles. More particularly, the invention is directed to a method of treating cotton textiles to impart softness and durable hydrophilic properties to the textiles.

BACKGROUND OF THE INVENTION

Textiles, and particularly cotton and cotton blend textiles, are often treated with silicone finishing agents to provide softness, improve tear strength, flex abrasion, processibility and wrinkle recovery. These finishing agents are generally applied to the textile from aqueous systems in pad-dry-cure operations.

Commonly employed types of silicone finishing agents are the polysiloxanes containing pendant organic groups. The silicone finishing agents which have been typically used heretofore have hydrophobic properties and result in the fabrics having little or no water absorbency. When hydrophilic silicone copolymers are used, the textiles have improved hydrophilic properties, but these finishes generally have poor durability. To improve the durability of the hydrophilic silicone finishes, reactive or curable organomodified silicones are generally used.

One example of the efforts to produce durable silicone finishes on textiles is disclosed in U.S. Pat. No. 4,459,383. The fiber-treating composition includes at least two reactive organosilicones which are able to react with each other and form durable finishes. The organomodified silicones include (1) an epoxy-substitutes siloxane and (2) an amino or carboxy-substituted and polyether-containing siloxane copolymer. The epoxy silicone is reacted with the amino-containing siloxane or alternatively the carboxyl-containing siloxane during curing to crosslink the siloxanes onto the fibers.

Other silicone finishing agents include silicone copolymers having polyoxyalkylene substituents and hydrolyzable di- or trialkoxysilyl groups. The silicones are applied to the fabric in the presence of moisture where the alkoxysilyl groups are hydrolyzed and cured at elevated temperatures. One example of this form of silicone finishing agent is disclosed in U.S. Pat. No. 4,283,519. A hydrophilic organosilicone includes a trialkoxysilyl pendant group and a polyoxyethylene/-polyoxypropylene chain terminated with a hydrogen or an acyl group. The silicone is applied to the fabric and cured by heating in the presence of a catalyst.

U.S. Pat. No. 4,758,646 discloses a bis (alkoxysilyl) polyether copolymer as a fabric sizing agent. The sizing agent is applied to the fabric and cured by heating to produce a hydrophilic finish having antistatic and soil release properties.

Glyoxal has been known to react with cotton and produce durable press finishes for cotton related fabrics such as that disclosed in U.S. Pat. No. 4,472,167. In this patent, an aqueous solution of glyoxal, glycol and an acid catalyst is applied to a cellulosic textile and cured by heating. The glyoxal is reported to form acetal crosslinks with cellulose. The glycol is added as a coreactant additive to modify the length of the crosslinks in the network. An optional silanol-terminated silicone is reported to produce a treated fabric having considerable water repellency.

U.S. Pat. No. 4,269,603 discloses a durable press treatment for textile fabrics using an aqueous solution of glyoxal, a reactive hydrophobic silicone and a catalyst. The treating composition is cured at about 177° C. to 204° C. This curing temperature has the disadvantage of producing a significant loss of tear strength of the fabric. The treating composition is reported to impart wrinkle resistance and smooth drying performance.

The present invention is directed to a method of producing hydrophilic silicone finishes for cellulose-containing textiles, using glyoxal to bind silicone copolymers to the textile. The resulting silicone finishes are durable to washing and impart soft hydrophilic properties and durable press properties to the treated fabric.

SUMMARY OF THE INVENTION

The present invention is directed to finished textile materials and to a method of imparting durable hydrophilic softness to cellulose-containing textile materials. The hydrophilic finishes produced are sufficiently durable to withstand repeated washings in water and/or home laundering. The textile finish can be used with or without other textile finishes.

The hydrophilic finish of the invention is produced by forming a chemical bond between the cellulose portion of a textile substrate and a hydrophilic silicone via acetal formation with glyoxal. The hydrophilic finish-forming composition is a mixture of glyoxal, glycol, a reactive hydrophilic silicone and an acid catalyst. The cellulose-containing textile is impregnated with the composition and subjected to reactive conditions, such as heating. The hydrophilic silicone then becomes fixed to the textile to impart durable hydrophilic properties.

The preferred reactive silicones are the hydrophilic silicone random copolymers having a hydroxyl terminated organic polyether substituent. Preferably the silicone copolymers have primary or secondary hydroxyl terminated polyoxyalkylene chains. Preferably the polyoxyalkylene is a polyoxyethylene or a polyoxyethylene/polyoxypropylene copolymer where the ethyleneoxide content is such that the silicone is hydrophilic. The silicone copolymer may also be a terpolymer of polysiloxane, polyoxyethylene or polyoxyethylene/polyoxypropylene terminated with a hydroxy-, alkoxy-, acetoxy-end group and pendant groups which bear hydroxyl, amine, amide or thiol groups or groups capable of forming hydroxyl groups under reactive conditions. The preferred functional groups which are able to form hydroxyl groups are epoxy-pendant groups.

The reactive hydrophilic silicone when combined with the glyoxal and glycol provides durable hydrophilic softness to the textile and enhanced durable press performance compared to the glyoxal-glycol system alone. A hydrophilic silicone copolymer, which becomes chemically linked to the textile, provides improved durable wrinkle recovery angles, smooth drying performance and increased tear strength to the treated fabrics.

DETAILED DESCRIPTION OF THE INVENTION

The present invention is directed to a method of applying hydrophilic finishes to the surface of cellulose-containing textiles to impart durable hydrophilic properties. The resulting textiles have improved softness, wettability, and durable press properties. The hydrophilic finish can be applied to woven and nonwoven textiles containing cellulose fibers, such as for example cotton, flax, hemp and jute. The textile may be a blend of cellulose fibers and synthetic fibers such as, for example, a cotton/polyester blend.

The process of the invention applies a finishing agent solution to a textile and cures the finishing agent on the textile. The finishing agent solution includes glyoxal, glycol, an acid catalyst and a reactive hydrophilic silicone copolymer having a hydroxyl terminated polyether chain. Alternatively, the hydrophilic silicone copolymer may be a terpolymer with a polyether having hydroxy-, alkoxy- or acetoxy-end groups and functional pendant groups bearing hydroxyl, amine, amide or thiol group or groups capable of forming reactive hydroxyl groups. The functional pendant group may be, for example, an epoxy-pendant group. The hydrophilic silicone having the hydroxyl group or functional group capable of forming hydroxyl groups under reaction conditions is linked to the cellulose substrate to impart durable hydrophilic properties to the textile. The chemical linkage between the cellulose and the silicone is formed by the use of the acid catalyzed reaction of glyoxal, silicone and cellulose. The finish is generally produced by applying an aqueous solution of the silicone copolymer, glyoxal, glycol and acid catalyst to the cellulose textile, which is then dried and cured by heating at about 120° to about 180° C.

The textiles treated in accordance with the invention possess durable hydrophilic softness. In the presence of an acid catalyst, glyoxal forms acetal links between the cellulose and hydroxyl group of the silicone copolymer.

The silicone copolymers of the invention are preferably random hydrophilic silicone copolymers having a polyoxyalkylene chain, hydroxyl groups or functional groups capable of forming hydroxyl groups under reactive conditions, and are reactive with glyoxal to form linkages between the silicone and the cellulose textile via the acetal formation. In a preferred embodiment of the invention, the reactive silicone is a copolymer having a polyether chain with hydroxyl end groups or alternatively a terpolymer with polyether and reactive pendant groups.

The preferred silicone copolymer is represented by the formula:

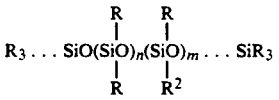

wherein R at each occurrence is a monovalent hydrocarbon radical. R may be, for example, an alkyl preferably having from 1 to 4 carbon atoms, aryl or arylalkyl. Most preferably R is methyl. In the above formula, n is an integer and m is an integer equal to or greater than 1. For example, n may be about 10 to about 150. $R^2$ at each occurrence is represented by the formula $$-(CH_2)_x(OR^3)_y(OR^4)_zR^5$$

with recurring units $OR^3$ and $OR^4$, where $R^3$ and $R^4$ are the same or different and are $C_2H_4$ or $C_3H_6$. $R^5$ is hydroxyl. In the formula, x, y and z are integers with the proviso that x and at least y or z are not zero. In the formula, n, m, x, y and z are selected such that the silicone is soluble or at least lightly soluble or dispersible in water at room temperature. The amount of ethyleneoxide in the copolymer is sufficient to impart hydrophilic properties to the silicone copolymer. $R^2$ consisting of oxyethylene and oxypropylene moieties linked in a random chain or in a block chain preferably has a molecular weight of about 150 to about 6,000 most preferably of about 350 to about 4,000.

In an alternative preferred embodiment the hydrophilic silicone copolymer has the general formula:

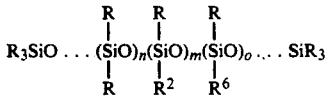

wherein R, n and m are as above and o is an integer of at least 1. $R^2$ at each occurrence is represented by the formula $$-(CH_2)_x(OR^3)_y(OR^4)_zR^5$$

wherein x, y, z, $R^3$ and $R^4$ are as above and $R^5$ is hydroxy-, alkoxy- or acetoxy-. The alkoxy preferably has 1 to 4 carbon atoms, In the preferred embodiment, $R^2$ has a molecular weight of about 150 to 6,000 and most preferably about 350 to 4,000. The amount of ethyleneoxide in the copolymer is sufficient to impart hydrophilic properties to the silicone copolymer. $R^6$ is a monovalent organic radical having one or more hydroxyl, diol, amine, amide, thiol or epoxide groups. Preferably $R^6$ has a pendant group selected from the group consisting of hydroxyl, diol and epoxide group. In the preferred embodiment $R^6$ is selected from the group consisting of

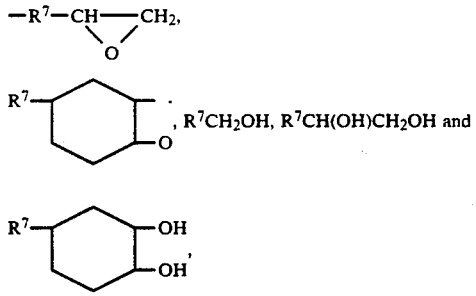

wherein $R^7$ is a divalent organic radical such as methylene, ethylene, propylene, phenylene, $-C_3H_6OCH_2-$ and $(CH_2)_3-O-$. Most preferably $R^6$ is

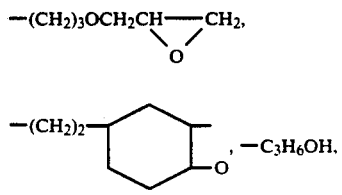

-continued

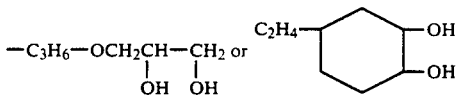

In the preferred embodiments, the silicone copolymer is soluble or dispersible in water. The silicone copolymer may be a liquid at room temperature or a waxy solid. Generally, the water solubility is enhanced by increasing the weight ratio of the polyoxyethylene group to the polyoxypropylene and to the silicone backbone in the molecule. For moderately water soluble silicone copolymers, a suitable surfactant may be used to disperse the silicone in water.

The glycol employed in the process may be a suitable diol which is able to react with the glyoxal. Glycols suitable for the process of the invention include, for example, straight chain alkanediols having the formula, $HOR^8OH$, wherein $R^8$ is an alkylene group having 2 t 12 carbon atoms or polyoxyalkylenes (polyethylene glycol or polypropylene glycol). The glycols preferably have a molecular weight of less than about 200. The most preferred glycols are diethylene glycol and triethylene glycols. Other glycols which may be used include, for example, ethylene glycol, propylene glycol and dipropylene glycol.

The glyoxal used is suitably a commercial grade material commonly supplied as a 40% aqueous solution. Although less preferred, the glyoxal may be obtained as a solid which is subsequently dissolved in water to form a solution of a desired concentration.

The preferred acidic catalysts are Bronsted or Lewis acids capable of catalyzing the reaction of the glyoxal with the cellulose. Suitable acid catalyst include, for example, p-toluenesulfonic acid, zinc chloride, zinc tetrafluoroborate, aluminum chloride, magnesium chloride, aluminum chlorohydroxide and mixtures thereof. In the preferred embodiment, the catalyst is a mixture of aluminum sulfate and tartaric acid as a catalyst activator. Other acid catalyst activators which are effective include citric acid, glycolic acid, lactic acid, malic acid and mixtures thereof. The mole ratio of the acid to aluminum sulfate may range from 0.5:1 to 15:1. The preferred range of tartaric acid to aluminum sulfate is about 0.5:1 to 5:1.

In the process of the invention the finishing agent is prepared as an aqueous solution containing about 1% to about 5% glyoxal on a solids basis, about 1% to about 15% by weight of a glycol, about 1% to 15% by weight hydrophilic silicone polymer, about 0.1% to 2% by weight acidic catalyst and 0% to 2% of catalyst activator. Preferably the molar ratio of glyoxal to glycol is about 1:1 to 1:2 in the finishing agent. Suitably the aqueous solution contains from about 3% to 15% by weight of a 40% glyoxal solution, 3% to 15% by weight glycol, 1% to 5% by weight hydrophilic silicone copolymer, 0.1% to 1% catalyst and 0% to 0.5% by weight of an optional acid catalyst activator with the balance to 100% with water.

The cellulose-containing textile is preferably impregnated in a bath with the treating solution and wet pick-up adjusted to 100% of the weight of the dry textile. Alternatively, the treating solution may be applied by spraying or by other suitable applicators. The moisture content of the impregnated textile maybe initially reduced by heating at an elevated temperature for about 2 to about 8 minutes and preferably about 3 minutes prior to substantial curing. The treated textile may then be cured by heating to a sufficient temperature for a sufficient period of time. The drying temperature may vary depending on the textile composition but will generally range from about 50° C. to 110° C. and is preferably about 85° C. The textile is then heated to cure the finishing agent on the textile at a temperature of about 110° C. to 180° C. The treated textile can be dried and cured in a one step heating process by heating the textile at a temperature of about 110° to about 180° C. The heating time to dry and cure the finishing agent is dependent on the amount of water remaining from the treating solution to be evaporated and the curing temperature. Suitably the curing time is about 0.5 to 5 minutes. Alternatively the heating step may be initiated, for example, at about 50° C. and gradually heated to about 180° C. over a sufficient period of time to dry and cure the finishing agent on the textile.

The following examples illustrate the preferred embodiments of the invention and are not intended to be limiting. The treated textiles were evaluated and compared for properties and characteristics. The testing methods employed were the standard methods as understood by those skilled in the art and include Wrinkle Recovery Angle by AATCC Method 66–1984, Durable Press Appearance by AATCC Method 124–1984, Wettability Test by AATCC Method 39–1980, Fabric Conditioning by ASTM Method D-1776-74, and Elmendorf Tearing Strength by ASTM D-1682-64.

The fabric used in the following examples was a bleached, desized mercerized cotton print cloth, Style 400M by Testfabric, Inc., Middlesex, N.J. The softness of the treated fabric was evaluated by a hand panel and the tested fabrics were rated using a scale of 1 to 10, where 1 is the softest and 10 is the harshest. In the following examples, durability is intended to refer to the resistance of the hydrophilic silicone to repeated washing or laundering. The durability of the hydrophilic silicone on the textile was assessed by determining the amount of the silicone on the treated fabrics before and after five machine washing cycles as conducted by AATCC standard machine wash conditions with AATCC Detergent 124 and standard drying procedure. Durable press properties are intended to refer to the overall properties of the textile including shrinkage control, wrinkle recovery angle, and smooth drying performance.

EXAMPLE 1

A mercerized, 100% cotton print cloth was treated with the aqueous treating composition as set forth in Table I below. Wet pick-up was adjusted to 100% by weight of the dry fabric. The treated fabrics were dried in a forced draft oven for about 3 minutes at 85° C. Subsequently, the dried treated fabrics were cured by heating in a forced draft oven at 125° C. for 2 minutes. The durability of the hydrophilic silicone copolymers was determined by a comparison of the silicone level on treated fabrics before washing and after five washing cycles. Standard AATCC machine wash conditions using AATCC Detergent 124 and drying were applied. The durability to washing is calculated as the percentage of initial level of the silicone determined on the unwashed fabrics. The accuracy of the analytical method was 10%.

TABLE 1

| SAMPLE NO. | 1 | 2 | | |
|---|---|---|---|---|
| Comparative Samples | | | A | B |
| | | Percent by Weight | | |
| Glyoxal, 40% solution | 6.0 | 12.0 | 6.0 | — |
| Diethylene glycol | 8.8 | 8.8 | — | — |
| (I) $Me_3SiO(Me_2SiO)_{13}(MeSiO)_5SiMe_3$ (with $C_3H_6(OC_2H_4)_7OH$) | 2.0 | 2.0 | 2.0 | 2.0 |
| Aluminum sulfate octadecahydrate | 0.77 | 0.77 | 0.77 | |
| Tartaric acid hydrate | 0.37 | 0.37 | 0.37 | |
| Water | 82.06 | 76.06 | 90.86 | 98.0 |
| Durability of the silicone | 65% | 72% | 33% | 12% |

The above data show a significant increase in the durability of the hydrophilic silicone copolymer on the cotton fabric from the treating solution containing glyoxal, diethylene glycol, and an acid catalyst compared to a similar treating solution without diethylene glycol or the silicone used alone.

EXAMPLE 2

A similar textile treatment was conducted on a mercerized cotton fabric using the process as in Example 1 for different treating solutions containing silicone copolymers having different silicone to polyethyleneoxide ratios. The durability of the silicone on the fabric was determined as in Example 1. The treating solution and resulting durability are shown in Table 2.

TABLE 2

| | SAMPLE NO. | | | |
|---|---|---|---|---|
| | 1 | 3 | 4 | 5 |
| | Percent by Weight | | | |
| Glyoxal, 40% solution | 6.0 | 6.0 | 6.0 | 6.0 |
| Diethylene glycol | 8.8 | 8.8 | 8.8 | 8.8 |
| (I) $Me_3SiO(Me_2SiO)_{13}(MeSiO)_5SiMe_3$ (with $C_3H_6(OC_2H_4)_7OH$) | 2.0 | — | — | — |
| (II) $Me_3SiO(Me_2SiO)_{30}(MeSiO)_5SiMe_3$ (with $C_3H_6(OC_2H_4)_7OH$) | — | 2.0 | — | — |
| (III) $Me_3SiO(Me_2SiO)_{45}(MeSiO)_5SiMe_3$ (with $C_3H_6(OC_2H_4)_7OH$) | — | — | 2.0 | — |
| (IV) $Me_3SiO(Me_2SiO)_{75}(MeSiO)_{10}SiMe_3$ (with $C_3H_6(OC_2H_4)_7OH$) | — | — | — | 2.0 |
| Aluminum sulfate octadecahydrate | 0.77 | 0.77 | 0.77 | 0.77 |
| Tartaric acid hydrate | 0.37 | 0.37 | 0.37 | 0.37 |
| Water | 82.06 | 82.06 | 82.06 | 82.06 |
| % ethylene oxide | 50 | 37 | 28 | 33 |
| Durability of the Silicone (%) | 65 | 41 | — (spots) | 33 |

The above data demonstrate that as the hydroxyl functionality and hydrophilicity increases as represented by the percent of the ethylene oxide in the copolymer, the durability of the hydrophilic silicone finish increases.

EXAMPLE 3

A textile treatment as in Example 1 was conducted on 100% cotton fabric using different treating solutions to compare the durability of silicones having a terminal primary or secondary hydroxyl groups on the organic group. The fabric was treated, dried and cured as in Example 1.

TABLE 3

| | SAMPLE NO. | |
|---|---|---|
| | 6 | 7 |
| Glyoxal, 40% solution | 6.0 | 6.0 |
| Diethylene glycol | 8.8 | 8.8 |
| (V) $Me_3SiO(Me_2SiO)_{40}(MeSiO)_{10}SiMe_3$ (with $C_3H_6(OC_2H_4)_{12}OH$) | 2.0 | — |
| (VI) $Me_3SiO(Me_2SiO)_{40}(MeSiO)_{10}SiMe_3$ (with $C_3H_6(OC_2H_4)_5(OC_3H_6)_6OH$) (random copolymer) | — | 2.0 |

TABLE 3-continued

| | SAMPLE NO. 6 | 7 |
|---|---|---|
| Aluminum sulfate octadecahydrate | 0.77 | 0.77 |
| Tartaric acid hydrate | 0.37 | 0.37 |
| Water | 82.06 | 82.06 |
| Durability % | 50% | 25% |

The durability of the hydrophilic silicone on the textile as shown in Table 3 is significantly greater for the silicone of Sample 6 having a primary hydroxyl group on the polyethyleneoxide pendant group. The primary hydroxyl group on the polyoxyethylene is more reactive than the secondary hydroxyl end group on the polyoxyethylene/polyoxypropylene pendant group, and produces a finish that is more durable to repeated washing.

EXAMPLE 4

This example considers the differences in durability between silicone copolymers having reactive hydroxyl end groups on the organo group and non-reactive silicone copolymers having methoxy end groups on the polyether organo group. In this example, compound VII is a hydrophilic silicone copolymer with a terminal hydroxyl group on the polyoxyethylene/polyoxypropylene chain. The organic block included about 75% by weight polyoxyethylene. Compound VIII is a methoxy terminated polyoxyethylene/polyoxypropylene silicone copolymer. The organic block of compound VIII included about 75% by weight polyoxyethylene. The treating solution having the composition as shown in Table 4 was applied to samples of mercerized, 100% cotton fabric. The treated fabric was dried and cured in one step in a forced air oven at 171° C. for 90 seconds. The fabric samples were washed using standard washing procedures. The durability of the finish is shown in Table 4. This data clearly demonstrate the increased durability of the silicone finish using the hydroxyl terminated polyether modified silicone compared to a non-reactive silicone. The residual durability of the non-reactive silicone (VIII) is believed to be due to the incomplete capping (85%) of the polyether. The remaining 15% contains hydroxyl functionality which may produce the semi-durable properties of this sample.

TABLE 4

| | SAMPLE NO. 8 (% by weight) | 9 |
|---|---|---|
| Glyoxal. 40% solution | 6.0 | 6.0 |
| Diethylene glycol | 8.8 | 8.8 |
| Aluminum sulfate octadecahydrate | 0.125 | 0.125 |
| Tartaric acid hydrate | 0.075 | 0.075 |
| (VII) $Me_3SiO(Me_2SiO)_{74}(MeSiO)_9SiMe_3$ <br> $\vert$ <br> $C_3H_6(OC_2H_4)_{23}(OC_3H_6)_6OH$ | 2.0 | — |
| (VIII) $Me_3SiO(Me_2SiO)_{74}(MeSiO)_9SiMe_3$ <br> $\vert$ <br> $C_3H_6(OC_2H_4)_{23}(OC_3H_6)_6OMe$ | — | 2.0 |
| Water | 83.0 | 83.0 |
| Durability | 56% | 31% |

EXAMPLE 5

The durability of the epoxy functional hydrophilic silicones was evaluated in this example. The aqueous treating solutions were prepared as Samples 10–13 according to Table 5. Compound IX is silicone terpolymer with a methoxy-terminated polyoxyethylene/polyoxypropylene and (3,4-epoxycyclohexyl)ethyl functional group. The polyoxyethylene/polyoxypropylene included about 40% by weight polyoxyethylene. Compound X is a silicone terpolymer with 3-glycidyloxypropyl and acetyl-terminated polyoxyethylene/polyoxypropylene, with higher epoxy content than Compound IX. The polyoxyethylene content in the polyoxyalkylene is about 40% by weight. Compound XI was a silicone terpolymer of 3-glycidyloxypropyl and acetyl-terminated polyoxyethylene/polyoxypropylene with higher epoxy content than Compound X. The polyoxyethylene content in the polyoxyalkylene was about 40% by weight. The solutions were applied to the cotton fabric and adjusted to 100% of the weight of the dry fabric. The fabrics were dried and cured in one step for 90 seconds at 171° C. in an oven. The durability of each silicone is recorded in Table 5. The data demonstrate high durability of the silicone bearing epoxide, which increases with the epoxy content in the molecule.

TABLE 5

| | Sample No. 10 | 11 (% by weight) | 12 | 13 |
|---|---|---|---|---|
| Glyoxal 40% | 6 | 6 | 6 | |
| Diethylene glycol | 8.8 | 8.8 | 8.8 | |
| Aluminum sulfate octadecahydrate | 0.2 | 0.2 | 0.2 | |
| Tartaric acid hydrate | 0.05 | 0.05 | 0.05 | |

TABLE 5-continued

| | Sample No. | | | |
|---|---|---|---|---|
| | 10 | 11 | 12 | 13 |
| | (% by weight) | | | |
| (IX) $Me_3SiO(Me_2SiO)_{85}(MeSiO)_m(MeSiO)_nSiMe_3$ | 1.0 | | | 1.0 |
| $C_2H_4$ — 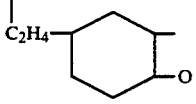 — O | | | | |
| $C_3H_6(OC_2H_4)_{25}(OC_3H_6)_{27}OMe_3$ | | | | |
| m + n = 7.5 | | | | |
| epoxide content 0.25% | | | | |
| (X) $Me_3SiO(Me_2SiO)_{85}(MeSiO)_o(MeSiO)_pMeSiO)_qSiMe_3$ | | 1.0 | | |
| $C_3H_6OCH_2$—CH—CH$_2$ (O) | | | | |
| $C_3H_6(OC_2H_4)_{36}(OC_3H_6)_{41}OCOCH_3$ | | | | |
| $C_3H_6(OC_2H_4)_{13}(OC_3H_6)_{15}OCOCH_3$ | | | | |
| o + p + q = 7.5 | | | | |
| o/p = 3:1 | | | | |
| epoxide content 0.4% | | | | |
| (XI) $Me_3SiO(Me_2SiO)_{85}(MeSiO)_s(MeSiO)_sMeSiO)_tSiMe_3$ | | 1.0 | | |
| $C_3H_6OCH_2$—CH—CH$_2$ (O) | | | | |
| $C_3H_6(OC_2H_4)_{36}(OC_3H_6)_{41}OCOCH_3$ | | | | |
| $C_3H_6(OC_2H_4)_{13}(OC_3H_6)_{15}OCOCH_3$ | | | | |
| 2s + t = 7.5 | | | | |
| epoxide content 0.7% | | | | |
| Water | 83.95 | 83.95 | 83.95 | 99.0 |
| Durability after 5 washing cycles | 61% | 67% | 79% | 23% |

EXAMPLE 6

The durability of the hydrophilic silicones having diol pendant groups produced from the epoxy-functional silicones is demonstrated in this example as Samples 14 and 15. Compounds IX and XI from Example 5 were refluxed in a water/isopropanol solution in the presence of 0.2% trifluoroacetic acid for 2 hours to hydrolyze the epoxy group and form Compounds XII and XIII respectively. The hydrolysis efficiency was determined by titration of the residual epoxide to be 85% to 90%. The treating solution was prepared as shown in Table 6 according to the method of Example 1. The treated fabric was dried and cured at 171° C. for 90 seconds. The durability of the silicone was determined as shown in Table 6. This data shows that the silicones having pendant diol groups have similar durability as the epoxy-pendant silicones.

TABLE 6

| | Sample No. | |
|---|---|---|
| | 14 | 15 |
| | (% by weight) | |
| Glyoxal, 40% | 6 | 6 |
| Diethylene glycol | 8.8 | 8.8 |
| Aluminum sulfate octadecahydrate | 0.2 | 0.2 |
| Tartaric acid hydrate | 0.05 | 0.05 |
| (XII) $Me_3SiO(Me_2SiO)_{85}(MeSiO)_m(MeSiO)_nSiMe_3$ | 1.0 | |
| $C_2H_4$ — 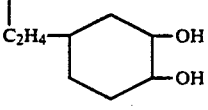 — OH, OH | | |
| $C_3H_6(OC_2H_4)_{25}(OC_3H_6)_{27}OMe$ | | |
| m + n = 7.5 | | |

TABLE 6-continued

| | Sample No. 14 | Sample No. 15 |
|---|---|---|
| | (% by weight) | |
| (XIII) $Me_3SiO(Me_2SiO)_{85}(MeSiO)_s(MeSiO)_s(MeSiO)_tSiMe_3$ | | 1.0 |
| $C_3H_6OCH_2-CH(OH)-CH_2(OH)$ | | |
| $C_3H_6(OC_2H_4)_{36}(OC_3H_6)_{41}OCOCH_3$ | | |
| $C_3H_6(OC_2H_4)_{13}(OC_3H_6)_{15}OCOCH_3$ | | |
| 2s + t = 7.5 | | |
| Water | 83.85 | 83.95 |
| Durability after 5 washing cycles | 61% | 67% |

EXAMPLE 7

This example evaluates the durable press properties of the glyoxal-glycol-hydrophilic silicone systems. The treating solutions were prepared in accordance with Table 7. The solutions were applied to the cotton fabric samples and adjusted to 100% of the weight of the fabric. The fabrics were dried and cured at 171° C. for 90 seconds. The properties of the fabrics were determined as shown in Table 7.

TABLE 7

| | Sample No. 16 | Sample No. 17 | Comparative Sample C |
|---|---|---|---|
| | (% by weight) | | |
| Glyoxal, 40% | 6.0 | 6.0 | 6.0 |
| Diethylene glycol | 8.8 | 8.8 | 8.8 |
| Aluminum sulfate octadecahydrate | 0.125 | 0.125 | 0.125 |
| Tartaric acid hydrate | 0.075 | 0.075 | 0.075 |
| Copolymer IX | 2.0 | | |
| Copolymer VII | | 2.0 | |
| Water | 83.0 | 83.0 | 85.0 |
| Cond. WRA (f + w degrees) | | | |
| initial | 301 | 300 | 272 |
| after 3 washes | 295 | 285 | 230 |
| tear strength retention (w) | 49% | 44% | 31% |
| Wetting time (seconds) | | | |
| initial | 9 | 6 | 6 |
| after 3 washes | 30 | 10 | 3 |
| Durable press rating (average) | 3.3 | 3.4 | 3.1 |
| Softness | 2.5 | 2.5 | 6 |

Copolymers VII and IX are as in Example 4 and Example 5 respectively.

The data demonstrate that the glyoxal, glycol, hydrophilic silicone, catalyst process results in improved tear strength, wrinkle recovery, durable press rating and softness compared to the glyoxal-glycol system without the silicone.

The above examples are intended to be exemplary of the preferred embodiments of the invention. It will be readily recognized by those skilled in the art that other modifications and embodiments can be made without departing from the spirit and scope of the invention as set forth in the following claims.

What is claimed is:

1. A process of forming durable hydrophilic silicone finishes on textiles formed at least partially of cellulosic fibers such finishes withstanding repeated washing in water which process comprises:

(a) impregnating the textile with a finishing agent comprising glyoxal, glycol, acidic catalyst and at least one organomodified silicone terpolymer having the formula:

$$R_3SiO\ldots(\underset{R}{\underset{|}{Si}}O)_n(\underset{R^2}{\underset{|}{Si}}O)_m(\underset{R^6}{\underset{|}{Si}}O)_o\ldots SiR_3$$

wherein R at each occurrence is a monovalent hydrocarbon radical; n is an integer; m and o are each an integer equal to or greater than 1; and $R^2$ has the formula $-(CH_2)_x(OR^3)_y(OR^4)_zR^5$ wherein $OR^3$ and $OR^4$ are repeating units; $R^3$ and $R^4$ are the same or different and selected from the group consisting of $C_2H_4$ and $C_3H_6$; x, y and z are integers with the proviso that x and at least y or z are not zero; $R^5$ is alkoxy or acetoxy; n, m, x, y and z are selected such that the silicone is soluble or dispersible in water at room temperature; $R^6$ is a monovalent organic radical having a reactive group consisting of an epoxide group, amide group and a thiol group; and (b) heating the textile to cure the finishing agent.

2. The process of claim 1 wherein R is methyl.

3. The process of claim 1 wherein the finishing agent is an aqueous solution comprising by weight about 1% to 5% glyoxal, about 1% to 15% glycol, about 1% to 15% silicone copolymer, about 0.1 to 2% acid catalyst and 0% to 2% catalyst activator based on the weight of the solution.

4. The process of claim 1 wherein the finishing agent is cured by heating to about 110° C. to 180° C.

5. The process of claim 1 wherein the catalyst is selected from the group consisting of p-toluenesulfonic acid, zinc chloride, zinc tetrafluoroborate, aluminum chloride, magnesium chloride, aluminum chlorohydroxide, aluminum sulfate and mixtures thereof.

6. The process of claim 5 wherein said catalyst further includes a catalyst activator selected from the group consisting of tartaric acid, citric acid, glycolic acid, lactic acid, malic acid and mixtures thereof.

7. The process of claim 1 wherein the glycol is selected from the group consisting of alkanediols and polyoxyalkylene diols, wherein said glycol has a molecular weight of less than about 200.

8. The process of claim 1 wherein the molar ratio of glyoxal to glycol is about 1:1 to about 1:2 in the finishing agent.

9. The process of claim 1 wherein $R^6$ is selected from the group consisting of

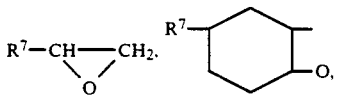

wherein $R^7$ is selected from the group consisting of methylene, ethylene, propylene, phenylene, $—C_3H_6OCH_2—$ and $—(CH_2)_3O—$.

10. A textile formed at least partially of cellulosic fibers having a durable hydrophilic finish that withstands repeated washing in water produced by the steps of:

(a) impregnating the textile with a finishing agent comprising glyoxal, at least one glycol, at least one acidic catalyst and at least one organomodified silicone terpolymer having the formula:

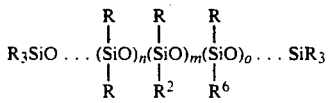

wherein R at each occurrence is a monovalent hydrocarbon radical, n is an integer; m and o are each an integer equal to or grater than 1; and $R^2$ has the formula $—(CH_2)_x—(OR^3)_y(OR^4)_zR^5$ wherein $OR^3$ and $OR^4$ are repeating units; $R^3$ and $R^4$ are the same or different and selected from the group consisting of $C_2H_4$ and $C_3H_6$; x, y, z are integers with the proviso that x and at least y or z are not zero; $R^5$ is alkoxy or acetoxy; n, m, x, y and z are selected such that the silicone is soluble or dispersible in water at room temperature; and $R^6$ is a monovalent organic radical having a reactive group selected from the group consisting of an epoxide group, an amide group and a thiol group; and (b) heating the textile to cure the finishing agent.

11. The textile of claim 10 wherein R is methyl.

12. The textile of claim 10 wherein the finishing agent is an aqueous solution comprising by weight about 1% to 5% glyoxal, about 1% to 15% glycol, about 1% to 15% silicone copolymer, and 0.1% to 2% acid catalyst and 0% to 2% catalyst activator based on the total weight of the solution.

13. The textile of claim 10 wherein the catalyst is at least one selected from the group consisting of p-toluenesulfonic acid, zinc chloride, zinc tetrafluoroborate, aluminum chloride, magnesium chloride, aluminum chlorohydroxide, aluminum sulfate and mixtures thereof.

14. The textile of claim 13 wherein said catalyst includes a catalyst activator selected from the group consisting of tartaric acid, citric acid, glycolic acid, lactic acid, malic acid and mixtures thereof.

15. The textile of claim 10 wherein the glycol is selected from the group consisting of alkylene glycols and polyoxyalkenes.

16. The textile of claim 10 wherein the molar ratio of glyoxal to glycol is about 1:1 to about 1:2 in the finishing agent.

17. The textile of claim 10 wherein $R^6$ is selected from the group consisting of

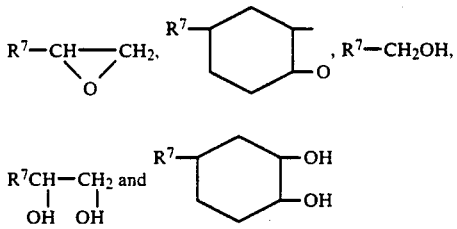

wherein $R^7$ is selected from the group consisting of methylene, ethylene, propylene, phenylene, $—C_3H_6OCH_2—$ and $—(CH_2)_3O—$.

* * * * *